United States Patent [19]

Allen

[11] Patent Number: 4,837,868

[45] Date of Patent: Jun. 13, 1989

[54] COMMODE DEVICE FOR INVALID PATIENTS

[76] Inventor: Joan A. Allen, 613 West State St., Marshalltown, Iowa 50158

[21] Appl. No.: 208,152

[22] Filed: Jun. 17, 1988

Related U.S. Application Data

[63] Continuation of Ser. No. 017,834, Feb. 24, 1987, abandoned.

[51] Int. Cl.[4] ..... A47K 11/06

[52] U.S. Cl. ..... 4/480; 4/483; 4/449

[58] Field of Search ..... 4/420, 449, 450, 460, 4/465, 476, 258, 480, 479, 424, 482, 483, 661, 477, 478; 220/352, 353, 345

[56] References Cited

U.S. PATENT DOCUMENTS

| | | | |
|---|---|---|---|
| 445,513 | 1/1891 | Powell | 4/460 |
| 521,463 | 6/1984 | Smith et al. . | |
| 765,582 | 10/1902 | Lang | 4/477 |
| 1,054,317 | 2/1913 | Sawyer | 4/460 |
| 1,691,620 | 11/1928 | Wilson . | |
| 2,495,374 | 1/1950 | Horn | 4/476 |
| 2,913,732 | 11/1959 | Jones . | |
| 3,795,923 | 3/1974 | Thomas | 4/483 |
| 4,510,631 | 4/1985 | Grady . | |
| 4,550,455 | 11/1985 | Carson et al. | 4/480 |

FOREIGN PATENT DOCUMENTS

| | | | |
|---|---|---|---|
| 74843 | 11/1892 | Fed. Rep. of Germany | 220/345 |
| 160376 | 11/1903 | Fed. Rep. of Germany | 4/479 |
| 880385 | 5/1953 | Fed. Rep. of Germany | 4/480 |

*Primary Examiner*—Henry J. Recla
*Assistant Examiner*—Linda J. Sholl
*Attorney, Agent, or Firm*—Zarley, McKee, Thomte, Voorhees & Sease

[57] ABSTRACT

A commode device for invalid patients is disclosed comprising a framemember having a plurality of legs with a toilet seat portion horizontally supported on the frame. A commode receptacle having a bottom, sidewalls, and an open top is detachably mounted on the frame directly below the toilet seat portion. An access port is provided in the sidewall of the commode receptacle to permit manual access into the interior of the receptacle to permit cleaning of a patient seated above the open top thereof. A closure means is provided on the access port to permit selective opening and closing thereof.

4 Claims, 1 Drawing Sheet

COMMODE DEVICE FOR INVALID PATIENTS

This is a continuation of copending application Ser. No. 017,834 filed on Feb. 24, 1987, now abandoned.

BACKGROUND OF THE INVENTION.

Commode devices for invalid patients have long been available. They normally comprise a supporting chair-like frame upon which a conventional toilet seat or the like is secured. A commode receptacle is conventionally detachably mounted below the toilet seat.

The difficulty presented by existing commode devices for invalid patients is that the patient must be lifted from or removed from the device for cleaning purposes, because this function cannot be accomplished while the patient is sitting on the device.

It is, therefore, a principal object of this invention to provide a commode device for invalid patients wherein the patient can be cleaned without either removing the patient from the device or without removing the commode device from the unit.

A further object of this invention is to provide a commode device for invalid patients that can be easily operated by even an unskilled person to effect the patient cleaning operation.

These and other objects will be apparent to those skilled in the art.

SUMMARY OF THE INVENTION.

The device of this invention is directed to a commode unit for invalid patients. The unit is comprised of a frame member having a plurality of legs with a toilet seat portion horizontally supported on the frame. A commode receptacle having a bottom, sidewalls, and an open top is detachably mounted on the frame directly below the toilet seat portion. An access port is provided in the sidewall of the commode receptacle to permit manual access into the interior of the receptacle to permit cleaning of a patient seated above the open top thereof. A closure means is provided on the access port to permit selective opening and closing thereof.

BRIEF DESCRIPTION OF THE DRAWINGS.

FIG. is a perspective view of the device of this invention.

Figure 1:
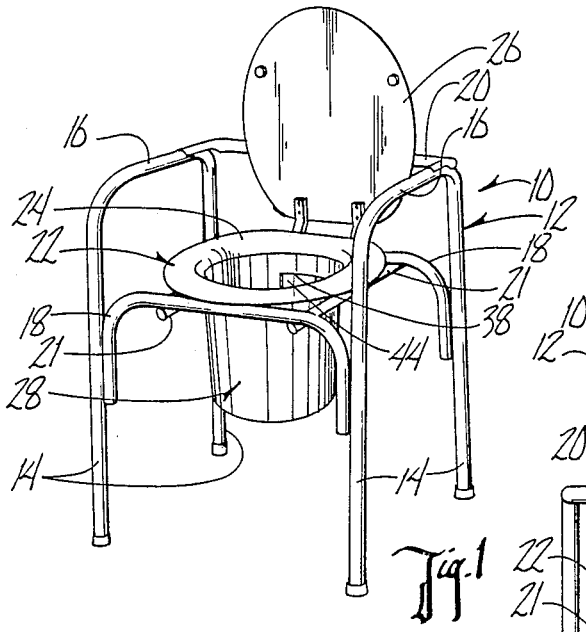

DESCRIPTION OF THE PREFERRED EMBODIMENT.

The manual 10 designates the commode device of this invention. Frame 12 includes a plurality of legs 14 with the upper ends of opposite pairs of legs terminating in horizontal arms 16. U-shaped braces 18 extend between forward and rearward pairs of legs and are secured thereto by any suitable means. A horizontally disposed back brace 20 interconnects the rearward end of arms 16. A pair of spaced-apart rods 21 are secured by their opposite ends to the opposed braces 18. As will be described hereafter, rods 21 serve to detachably support the commode receptacle.

A toilet seat 22 comprising a seat portion 24 and a lid 26 is secured to and supported on opposed braces 18 in any conventional manner.

A commode receptacle 28 is comprised of a bottom 30, cylindrical sidewall 32, and upper rim 34, and an open top 36.

Figure 3:
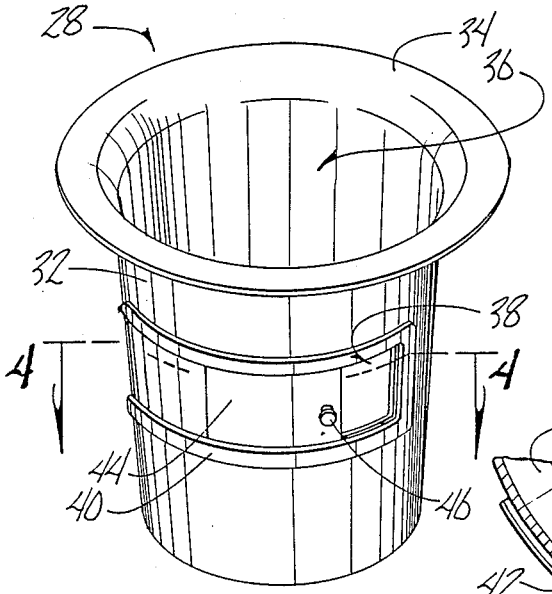
FIG. 3 is an enlarged scale perspective view of the commode receptable of this invention.
Figure 4:
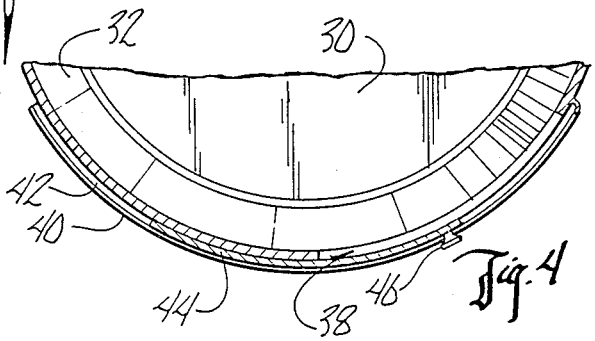
FIG. 4 is a partial sectional view thereof taken on line 4—4 of FIG. 3.

An access port 38 is located in sidewall 32. A frame 40 is secured to sidewall 32 around port 38 and is shaped so as to provide an open space 42 which slidably receives closure 44. Closure 44 has a length greater than that of port 38 to permit it to completely span and close, and to permit it to be slidably moved in a horizontal direction to permit port 38 to be completely accessible. As seen in FIG. 3, the left-hand end of frame 40 is open which will permit the removal of closure 44 from the frame 40 for cleaning purposes.

In operation, the commode receptacle 28 can be placed in supporting condition on rods 21 wherein the rods extend under the rim 34. Any other conventional means can be used to support the commode receptacle to the frame 12.

Figure 2:
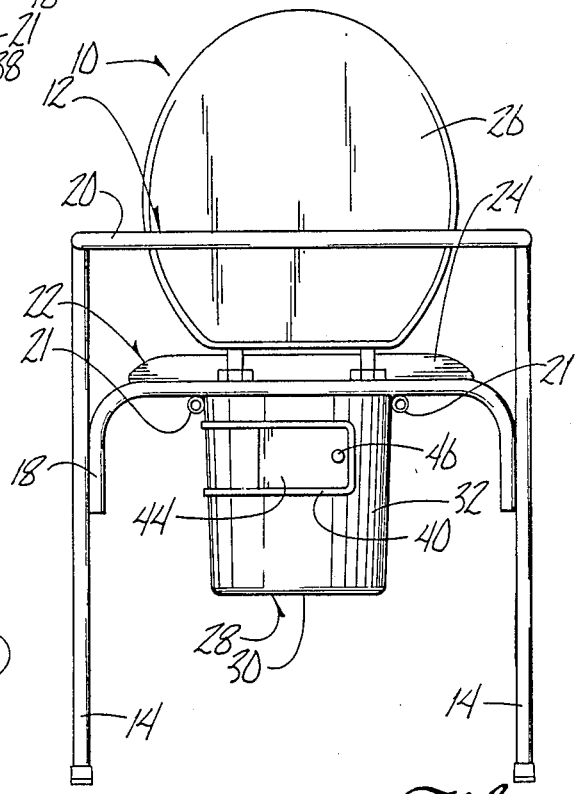
FIG. 2 is a rearward elevational view thereof shown at an enlarged scale.

While the patient is still sitting on the seat portion 24, the attendant can grasp the knob 46 of closed closure 44 (FIG. 2) and slide the closure to the left as viewed in that figure to open the access port 38. The attendant can then clean the patient through the access port 38 without having to lift or remove the patient from the unit.

The port 38 greatly facilitates the care of invalid patients. It adds to the comfort of the patient, the convenience of the attendant, and considerable time is saved.

Accordingly, this invention accomplishes at least all of the stated objectives.

I claim:

1. A commode device for invalid patients, comprising, a chair frame having a plurality of supporting legs, and a horizontally disposed toilet seat portion, a commode receptacle mounted on said frame below said toilet seat portion, said commode receptacle being generally cylindrically shaped and having a bottom portion, a substantially vertically straight continuous sidewall portion extending upwardly from said bottom portion and terminating at an open top, with said open top having a diameter substantially equal to the diameter of said commode receptacle as defined by said sidewall portion, an access port in said sidewall portion and elevated above said bottom portion to permit manual access to the interior of said commode receptacle to permit cleaning of an invalid patient seated over said open top, a closure means secured to said commode receptacle to permit said port to be selectively opened and closed, said closure means being substantially coextensive with the plane of said sidewall portion in both of its open and closed positions to permit easy access to the interior of said commode receptacle in confined spaces.

2. The device of claim 1 wherein said port is located in close relation to said open top.

3. The device of claim 1 wherein said closure means is slidably mounted in a frame element on said commode receptacle, said frame element including means to permit selective removal of said closure means from said frame element so that said closure means can be easily cleaned.

4. The device of claim 1 wherein said commode receptacle is mounted on said frame by means of a substantially horizontal rim that extends outwardly from the open top of said commode receptacle to engage a support means on said frame.

* * * * *